US008071901B2

(12) United States Patent
Poyner et al.

(10) Patent No.: US 8,071,901 B2
(45) Date of Patent: Dec. 6, 2011

(54) SAFETY SWITCH

(75) Inventors: Julian Poyner, Stockport (GB); Derek Jones, Galloway (GB); Derek Sawyer, Granada (ES)

(73) Assignee: Rockwell Automation Limited, Malden, Essex (GB)

( * ) Notice: Subject to any disclaimer, the term of this patent is extended or adjusted under 35 U.S.C. 154(b) by 286 days.

(21) Appl. No.: 12/336,130

(22) Filed: Dec. 16, 2008

(65) Prior Publication Data

US 2009/0194405 A1 Aug. 6, 2009

(30) Foreign Application Priority Data

Jan. 31, 2008 (GB) ..... 0801704.8

(51) Int. Cl.
*H01H 27/00* (2006.01)

(52) U.S. Cl. ..... 200/334; 200/43.04; 200/43.07; 200/61.62

(58) Field of Classification Search ..... 200/43.04, 200/61.62, 63.07, 334, 43.07
See application file for complete search history.

(56) References Cited

U.S. PATENT DOCUMENTS

| | | | | |
|---|---|---|---|---|
| 3,925,722 | A * | 12/1975 | Fohrhaltz et al. | 324/415 |
| 4,963,706 | A * | 10/1990 | Mohtasham | 200/334 |
| 5,420,571 | A * | 5/1995 | Coleman et al. | 340/644 |
| 5,464,954 | A * | 11/1995 | Kimura et al. | 200/61.62 |
| 5,517,381 | A * | 5/1996 | Guim et al. | 361/102 |
| 7,332,989 | B2 * | 2/2008 | Jones | 335/132 |
| 7,400,986 | B2 * | 7/2008 | Latham et al. | 702/57 |
| 7,405,569 | B2 * | 7/2008 | Hagel et al. | 324/421 |
| 7,429,708 | B1 * | 9/2008 | Poyner et al. | 200/43.04 |
| 7,506,180 | B2 * | 3/2009 | Klaffenbach et al. | 713/300 |
| 7,705,601 | B2 * | 4/2010 | Zhou et al. | 324/424 |
| 2008/0164129 | A1 * | 7/2008 | Jones | 200/61.81 |

* cited by examiner

*Primary Examiner* — Michael Friedhofer
(74) *Attorney, Agent, or Firm* — Boyle Fredrickson, S.C.; William R. Walbrun; John M. Miller

(57) ABSTRACT

A safety switch for affecting the operating state of equipment to which the safety switch is at least indirectly connected. The safety switch includes a configuration, such as a number of contacts, that is arranged to change from a first condition to a second condition depending on whether or not an actuator has been engaged with or disengaged from the safety switch. The safety switch includes an arrangement for determining information that is at least indicative of an operational property of the configuration, and for storing information that is at least indicative of the obtained information.

26 Claims, 7 Drawing Sheets

SAFETY SWITCH

CROSS-REFERENCE TO RELATED APPLICATION

This application claims priority to Great Britain Patent Application No. 0801704.8 filed on Jan. 31, 2008, and the disclosure of which is expressly incorporated herein.

BACKGROUND

The present invention relates to a safety switch, and in particular a safety switch arrangement.

Safety switches are well known, and are typically used to prevent access to for example dangerous electromechanical machinery when that machinery is in operation. In a conventional arrangement the safety switch is mounted on a doorpost of a machinery guard, and an actuator for the safety switch is mounted on a corresponding door. When the door is closed the actuator engages with the safety switch, which in turn closes a set of electrical contacts which allow power to be supplied to the machinery. This arrangement ensures that power can only be supplied to the machinery when the guard door is shut. When the guard door is opened, the actuator disengages from the safety switch, thereby opening the electrical contacts and cutting off the supply of power to the machinery.

A typical safety switch comprises a housing, in which is provided a set of contacts fixed in position relative to the housing. An axially slideable plunger is mounted inside the housing, and is moveable relative to the housing. The plunger (or another plunger in contact with the plunger, for example a contact block plunger) is provided with another set of contacts. The plunger is biased towards a cam arrangement by a spring. The actuator mentioned above is arranged to engage with the cam arrangement.

In many safety switches, if the actuator is not engaged with the cam arrangement (i.e. if the actuator is not engaged with the safety switch), the cam arrangement is arranged to prevent the contacts on the plunger coming into contact with the contacts of the housing by preventing movement of the plunger (i.e. the plunger is kept in a first plunger position). By preventing the contacts from contacting one another, the switch cannot conduct electricity while the actuator is not engaged with the cam arrangement.

Bringing the actuator into engagement with the cam arrangement causes the cam arrangement to rotate, which in turn causes the plunger (which is biased toward the cam arrangement) to move into a notch provided in the cam arrangement. The plunger is then in a second plunger position. When the plunger moves into the notch, the contacts on the plunger are brought into contact with the contacts of the housing, allowing electricity to flow through the safety switch.

Before a safety switch is sold to a customer, it is often desirable to undertake certain tests on that safety switch, or on a safety switch similar to that safety switch (for example, a safety switch from the same batch, production run, series of safety switch, etc.) to validate the quality of construction and operability of the switch. For instance, it may be desirable for the manufacturer or supplier of the safety switch to ensure that the safety switch performs to a desired level, for example a level quoted in literature or marketing documentation. The tests may also be desirable to ensure that the safety switch is of a desired standard, and is, for example durable enough to be used in the conditions in which the safety switch is intended to be used. For instance, in some jurisdictions throughout the world, safety switches have to meet certain safety criteria (for example, safety standards set by governments or government related bodies) which these switches have to meet in order to be sold or used in that particular country.

The testing mentioned above may take one of a number of forms. For instance, an actuator may be repeatedly engaged with and disengaged from the safety switch to check that the safety switch remains operable during and after the repeated engagement and disengagement. For example, the actuator may be engaged with and disengaged from the safety switch a hundred thousand times to ensure that, when sold, thereby increasing confidence that the same or similar safety switch will not fail prematurely.

If the safety switch (or switches) in question pass the test, the safety switch can be sold with reasonable confidence that the switch is durable enough to withstand a desired or expected number of operations. However, once sold, there is no way of telling how many times the safety switch has been used. For instance, there is no way of telling how many times somebody has entered and left an enclosure incorporating such a safety switch, and therefore how many times an actuator has been engaged with and disengaged from the safety switch. More importantly, there is no way of telling whether the safety switch is being used or has been used to such an extent that it exceeds the level up to which it was initially tested. For example, if the safety switch was tested to ensure that it retained structural integrity and an operating state for 50,000 operations, once installed for use, there is no reasonable way of telling the number of uses of the switch by the end user. That is, for an exemplary switch having an asserted useable life of at least 50,000 uses, there is no reasonable means for assessing if the end-user of the safety switch has used it 25,000 times and is within the level of testing, or if the end-user has used it 100,000 times and exceeded the level of testing. Since the safety switch may not have been tested to the extent which the end-user has used the switch, there is no way of telling if the safety switch is as safe as was intended. Clearly this is undesirable.

It is therefore an object of the present invention to provide a safety switch arrangement which may overcome or substantially mitigate at least one disadvantage of the prior art, whether identified herein or elsewhere.

SUMMARY OF THE INVENTION

According to the present invention there is provided a safety switch for affecting the operating state of equipment to which the safety switch is at least indirectly connected. The safety switch includes a configuration arranged to change from a first condition to a second condition depending on whether or not an actuator has been engaged with or disengaged from the safety switch. The safety switch includes an arrangement for determining information that is at least indicative of an operational property of the configuration, and for storing information that is at least indicative of the obtained information.

Preferably, the information may be stored with a display device. Alternatively, the information may be stored in a memory.

The configuration may be electromechanical. The configuration may comprise a contact that is fixed in position relative to the safety switch and a contact that is moveable relative to the safety switch. The moveable contact is preferably moveable into and out of contact with the fixed contact such that electrical current can or cannot flow between the moveable and fixed contacts. The configuration may comprise a fixed pair of contacts that are displaced from one another and a moveable bridging contact. The moveable bridging contact is preferably moveable into and out of contact with the fixed pair of contacts such that electrical current can or cannot flow through the bridging contact. The moveable contact may be carried by a plunger.

The arrangement may be configured to detect an electrical signal, or change in an electrical signal associated with the configuration. The arrangement may be configured to detect an electrical signal, or change in an electrical signal associated with the configuration when the configuration changes from the first to the second condition. The arrangement may be configured to detect a change in one or more of a current flowing through the arrangement, a potential difference across the arrangement, or a resistance of the arrangement. The arrangement may be configured to store information that is at least indicative of the number of times the change is detected. The arrangement may be configured to store the value of the current, potential difference, or resistance. The arrangement maybe configured to store the value of the current, potential difference or resistance each time the current, potential difference or resistance is detected to be above or below a pre-determined threshold. The arrangement may be configured to store the number of times the value of the current, potential difference or resistance each time the current, potential difference or resistance is detected to be above or below a pre-determined threshold. The arrangement may comprise an electrical circuit.

The arrangement may be arranged to detect mechanical movement of a part of the configuration. The arrangement may be arranged to detect movement of one or more of a cam arrangement, a plunger or a moveable electrical contact of the configuration of the safety switch, or the actuator when it is brought into or out of engagement with the configuration. The arrangement may be configured to store the number of times movement is detected. The arrangement may be configured to store the number of times movement is detected beyond a threshold value. The threshold value may correspond to the amount of movement necessary for the configuration to change from a first condition to a second condition.

The safety switch may be provided with a counter, with which information at least indicative of an operational property of the configuration may be stored. The counter may be electrical in nature. The counter may be mechanical in nature.

The safety switch may be provided with a display arranged to provide a visual indication of information at least indicative of an operational property of the configuration of the safety switch. The display maybe the counter mentioned above.

In use, the safety switch maybe arranged to be connected to the equipment using a wired arrangement. In use, the safety switch may be arranged to be connected to the equipment using a wireless arrangement.

The first condition of the configuration may be such that the supply of electricity to the equipment is allowed, and the second condition is such that the supply of electricity to the equipment is prevented. The first condition of the configuration may be such that the equipment is arranged to operate at a first speed, and the second condition is such that the equipment is arranged to operate at a second speed. The first condition of the configuration may be such that movement of at least a part of the equipment is allowed, and the second condition is such that movement of the equipment is prevented.

BRIEF DESCRIPTION OF THE DRAWINGS

Embodiments of the present invention will now be described, by way of example only, with reference to the accompanying drawings, in which.

DETAILED DESCRIPTION OF THE PREFERRED EMBODIMENTS

Figure 1:
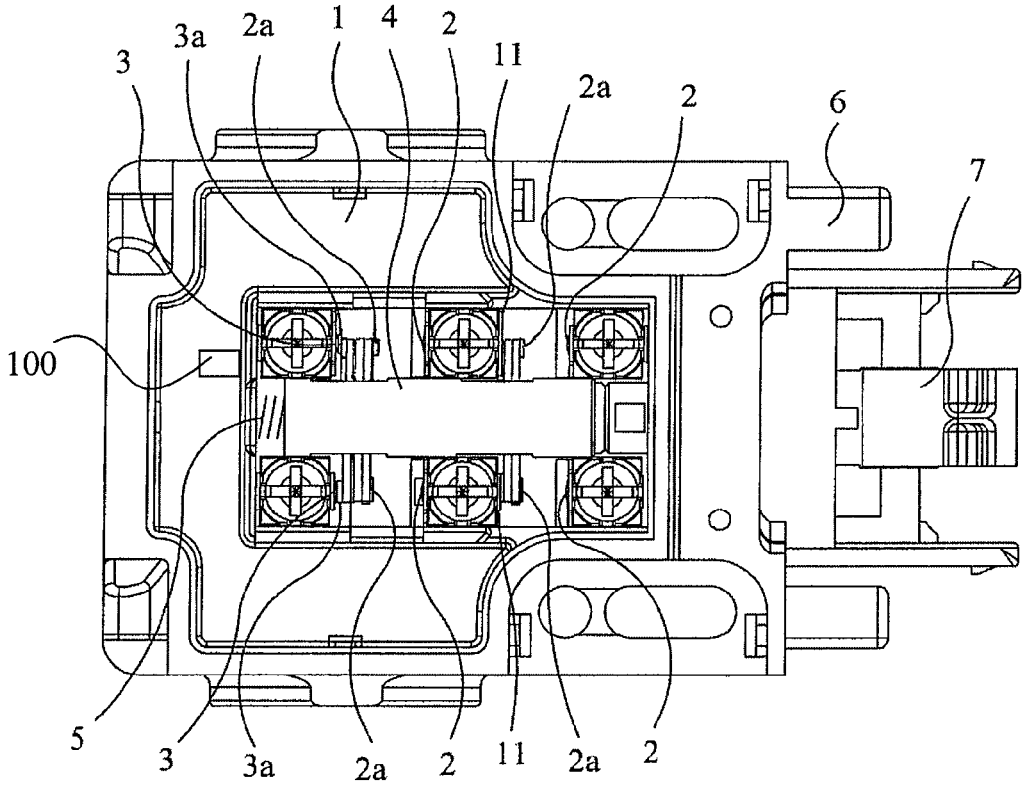
FIG. 1 schematically depicts a safety switch in accordance with an embodiment of the present invention.

FIG. 1 depicts a plan view of a safety switch in accordance with an embodiment of the present invention. The safety switch comprises a two-part housing. One part of the housing defines a main body 1 of the safety switch. Mounted within the body 1 are electrical contacts which are fixed in position relative to the body 1. The contacts consist of two fixed safety contacts 2 and a fixed auxiliary contact 3. Also mounted within the body 1 is a plunger 4 which is slideable relative to the body 1 in an axial direction. The plunger 4 is provided with a plurality of contacts which extend through the plunger 4 and which are moveable relative to the plunger 4. The moveable contacts comprise two moveable safety contacts 2*a* and a moveable auxiliary contact 3*a*. By moving the plunger 4, the moveable contacts 3*a*, 4*a* can be brought into contact (and thus electrical connection) with the fixed contacts 3, 4 of the safety switch. The plunger 4 is also provided with a moveable insulating barrier 11 which serves to provide additional electrical insulation for some of the moveable safety contacts 2*a*.

The plunger 4 is biased by a spring 5 towards a second part of the housing, which forms a head 6 of the safety switch. The head 6 of the safety switch is provided with a rotatable cam arrangement 7. The cam arrangement 7 is arranged to receive and engage with an actuator (not shown in FIG. 1). Engagement or disengagement of the actuator with the cam arrangement 7 causes the cam arrangement 7 to rotate, which in turn causes axial movement of the plunger 4 within the body 1 of the safety switch.

Figure 2A:
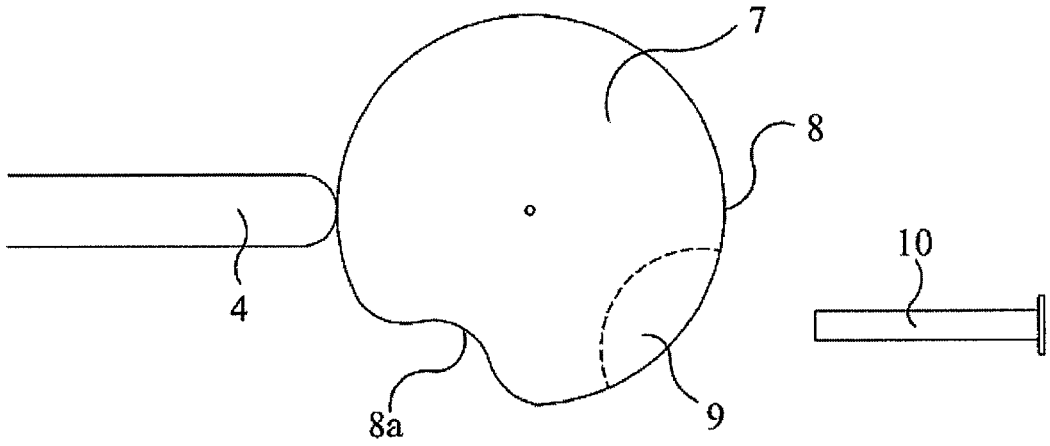
FIGS. 2*a* and 2*b* schematically depict a cam arrangement of the safety switch of FIG. 1.
Figure 2B:
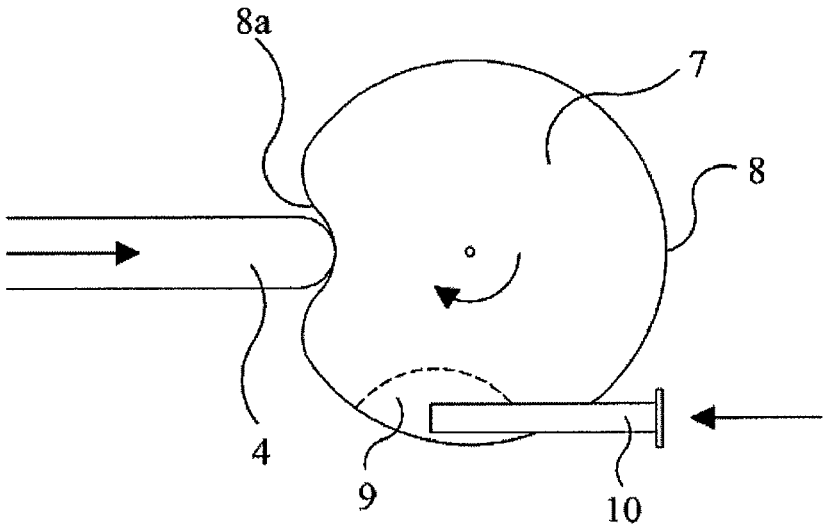

FIGS. 2*a* and 2*b* illustrate the interaction between the cam arrangement 7 and the plunger 4 in more detail. FIG. 2*a* shows that the cam arrangement 7 defines a cam surface 8. The cam surface 8 is provided with an indentation 8*a* which is (upon rotation of the cam arrangement 7) arranged to receive the plunger 4. The cam arrangement 7 is also provided with a notch 9 for receiving and engaging with an actuator 10. It can be seen from FIG. 2*a* that when no actuator is brought into engagement with the cam arrangement 7, the cam arrangement pushes back against the plunger 4 (which is biased toward the cam arrangement 7 by the spring 5) and prevents the plunger 4 from moving towards the cam arrangement 7. The plunger 4 is said to be in a first plunger position.

It can be seen from FIG. 1 (in combination with FIG. 2*a*) that when no actuator is brought into engagement with the cam arrangement 7, all of the fixed safety contacts 2 of the body 1 of the safety switch are kept apart from all of the moveable safety contacts 2*a* of the plunger 4. Thus, when no actuator is engaged with the cam arrangement 7, the safety contacts 2, 2*a* are not in electrical connection with each other, which prevents the safety switch from conducting electricity (to, for example, electrically powered machinery with a machine guard). When no actuator is engaged, the auxiliary contacts 3, 3*a* are in contact with each other, which may allow an auxiliary power supply to be supplied to the switch (for example, to power a light which indicates that no actuator has been engaged with the switch).

FIG. 2*b* depicts an actuator 10 that has been brought into engagement with the cam arrangement 7. It can be seen from FIG. 2*b* that when the actuator 10 has been brought into engagement with the cam arrangement 7, the cam arrangement 7 and therefore cam surface 8 are arranged to rotate in a clockwise direction. Rotation of the cam arrangement 7 causes the indentation 8*a* in the cam surface 8 to be brought into alignment with the plunger 4. As the indentation 8*a* moves into alignment with the plunger 4, which is biased by the spring 5, the plunger 4 moves towards the right of FIG. 2*b*. The plunger 4 is said to be in a second plunger position.

Figure 3:
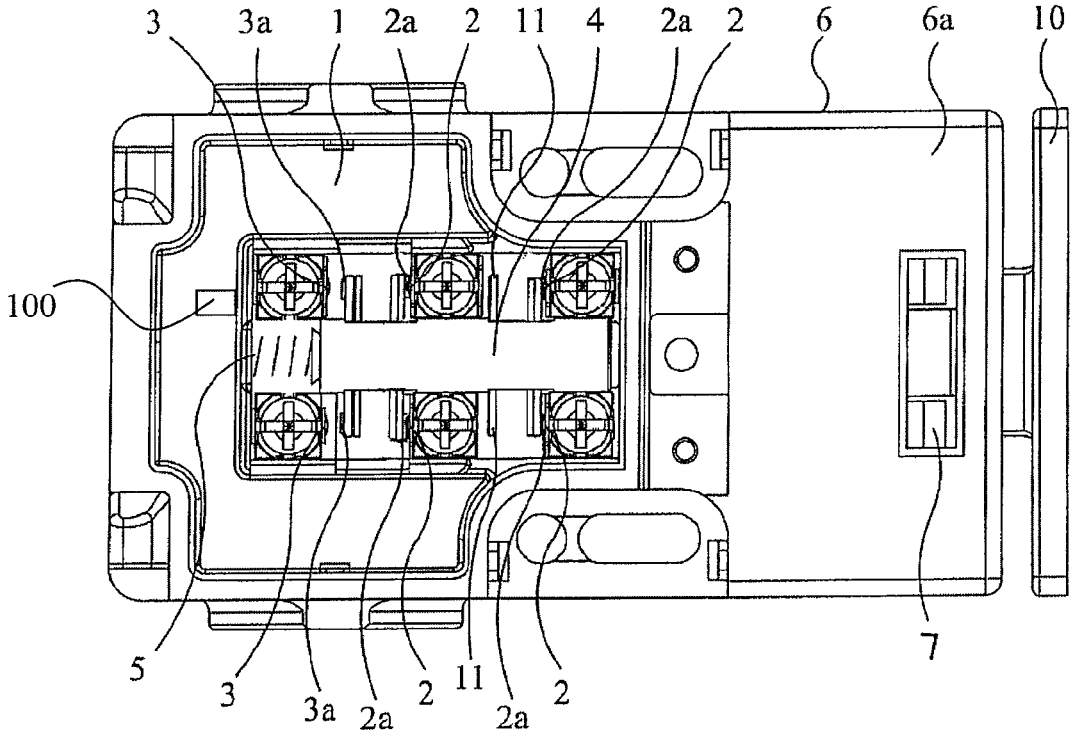
FIG. 3 schematically depicts operating principles of the safety switch of FIG. 1.

FIG. 3 shows the safety switch with an end cap 6*a* enclosing the head 6 of the safety switch. The end cap 6*a* protects the cam arrangement 7 from damage, dust etc, and makes the safety switch appear more aesthetically pleasing. It can be seen from FIG. 3 that when the actuator 10 is brought into engagement with the cam arrangement 7, the plunger 4 moves towards the right of FIG. 3. When the plunger 4 moves to the right, all of the moveable safety contacts 2*a* are brought into electrical connection with the fixed safety contacts 2 of the body 1 of the safety switch. When all of the safety contacts 2, 2*a* are brought into electrical connection with each other, the switch is capable of conducting electricity (to, for example, electrically powered machinery with a machine guard). The safety switch is configured such that if one or more of the safety contacts 2, 2*a* are not in electrical connection with each other, the switch is incapable of conducting electricity.

The thus far described features and operating mechanisms of the safety switch can be found in prior art safety switches. The safety switch shown in and described with reference to FIGS. 1 to 3 includes circuitry 100, and the function of the circuitry 100, as shown and described with respect to FIGS. 4-7. The circuitry 100 is configured to obtain information at least indicative of the operation of the safety switch. Information obtained by the circuitry 100 can be stored and/or displayed. The information may be used by a user and/or those who service the safety switch so that they can readily obtain information regarding the operation of the safety switch. For instance, the circuitry 100 may be configured to determine the number of times an actuator has been engaged with or disengaged from the safety switch, and be arranged to store this information for access by a user, or display this information for the user. The information may be displayed in the form of a count, an alert (e.g. a warning if a certain or preselected threshold is approached or exceeded), or in any appropriate manner. The user may then decide to take appropriate action depending on the stored and/or displayed information, be instructed to take this action, or been informed that an action has automatically been taken as a result of a threshold being approached or exceeded. In contrast to prior art safety switches, the safety switch in accordance with an embodiment of the present invention is more useful since it provides information which may be diagnostic or prognostic, and may give the user of the safety switch an indication of a need to replace the safety switch, maintain a safety switch, etc. In one example, this means that it is possible for the user to determine how many times the safety switch has been used, and how this usage compares with the level of testing of a safety switch from the same batch, production run, etc.

Figure 4A:
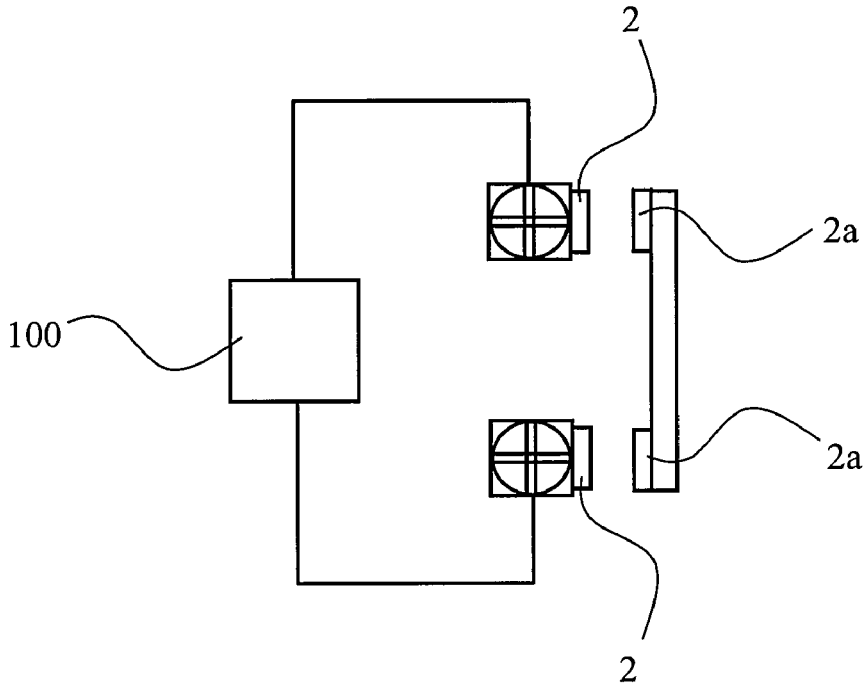
FIGS. 4*a* and 4*b* schematically depict circuit arrangements in accordance with an embodiment of the present invention.
Figure 4B:
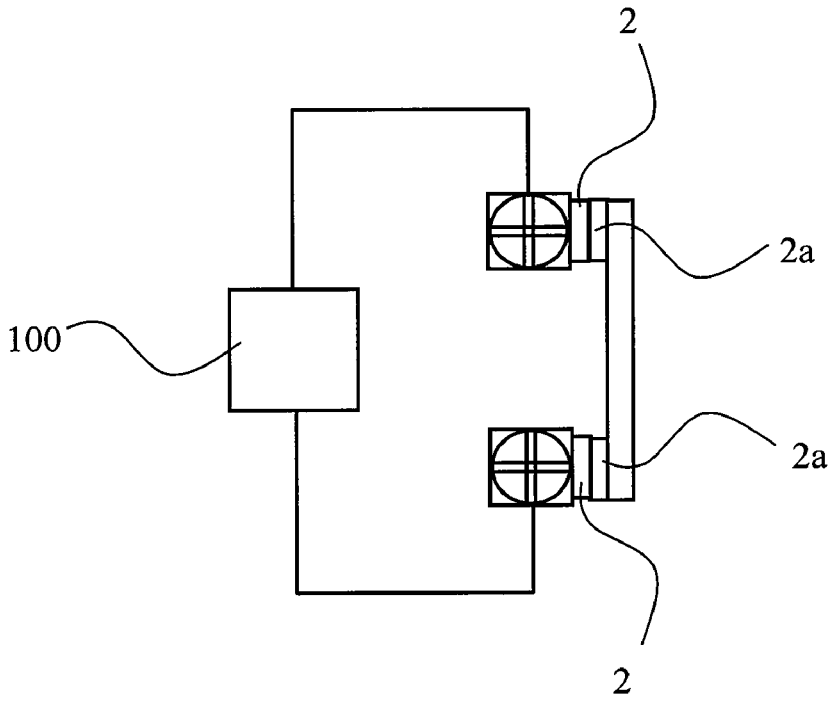

FIGS. 4*a* and 4*b* schematically depict circuits which give an example of how the circuitry 100 may obtain information that is indicative of the operation of the safety switch. The circuitry 100 is shown as being in electrical connection with two fixed safety contacts 2 of the safety switch (the rest of the safety switch is not shown for clarity). Movable safety contacts 2*a* are also shown in relation to the fixed safety contacts 2. In practice, and as illustrated in FIGS. 1 and 3, the moveable safety contacts 2*a* are carried by a plunger, although the plunger is not shown in this Figure for clarity reasons. It can be seen that one end of the movable safety contacts 2*a* is adjacent one of the fixed safety contacts 2, and the other end of the movable safety contacts 2*a* is adjacent to another of the fixed safety contacts 2.

FIG. 4*b* shows the situation when the movable safety contacts 2*a* have been brought into contact with the fixed safety contacts 2. For example, such movement may be undertaken when the actuator is brought into engagement with the safety switch, or is disengaged from the safety switch, as described above in relation to earlier Figures. It can be seen that the movable safety contacts 2*a* electrically connect the fixed safety contacts 2. In other words, the movable safety contacts 2*a* serve as bridging contacts, extending between the two fixed safety contacts 2. It can also be seen that an electrical circuit has now been formed. The circuitry 100 can use the opening or closing (or in other words, making or breaking) of the safety contacts 2, 2*a* to obtain information indicative of the operation of the safety switch.

In one example, each time the movable safety contacts 2*a* are moved into contact with and bridge the fixed safety contacts 2, electrical current may flow through the circuitry 100. Each time current flow is detected, a counter of circuitry 100 may be increased. The counter may be increased incrementally, or in any suitable manner, and may be stored in the circuitry 100, be part of the circuitry 100, or be in connection with the circuitry 100. The counter will therefore contain information at least indicative (and more likely directly proportional to or equal to) the number of times the safety contacts 2, 2*a* have been brought together. In other words, the counter will store information at least indicative of the number of times an actuator has been engaged with the safety switch. The circuitry 100 may be arranged to detect the absence or a reduction in the current, such that the opening, breaking, moving apart, etc., of the moveable safety contacts 2*a* and fixed safety contacts 2 may also be detected and used to affect the value of a counter. As mentioned above, information in or on the counter may be stored and/or displayed. A user of the safety switch may be able to access this information, virtually or otherwise, in order to determine if the safety switch has been used for a number of occasions which is approaching, equal to or exceeding a previously determined or defined testing threshold.

It is appreciated that there are a number of ways of assessing the number of operations of the safety switch. For example, circuitry 100 can count the number of times the safety contacts 2, 2*a* are brought into contact with one another, or the number of times when the safety contacts 2, 2*a* are moved apart from one another. When, for instance, the safety contacts 2, 2*a* have been brought into contact with one another, other information may be obtained. For example, the current flowing through the safety contacts 2, 2*a* may be determined, or the resistance across the contacts 2, 2*a*, or the potential different across the contacts 2, 2*a*. All such information may be used to obtain information at least indicative of the operation of the safety switch. For instance, an increase in the measured resistance may indicate a build up of debris or similar between the fixed contacts 2 and the movable contacts 2*a*. An increase in resistance up to or beyond a certain level may detract from operation of the safety switch and/or render the safety switch inoperable. The circuitry 100 can store information indicative of the current flowing through the contacts, the resistance across the contacts, or the voltage across the contacts, or may add to a counter each time the measured values are lower than or exceed a threshold value. Such information may be stored and/or displayed such that a user of the safety switch may be able to easily access information regarding the operation of the switch.

Figure 5:
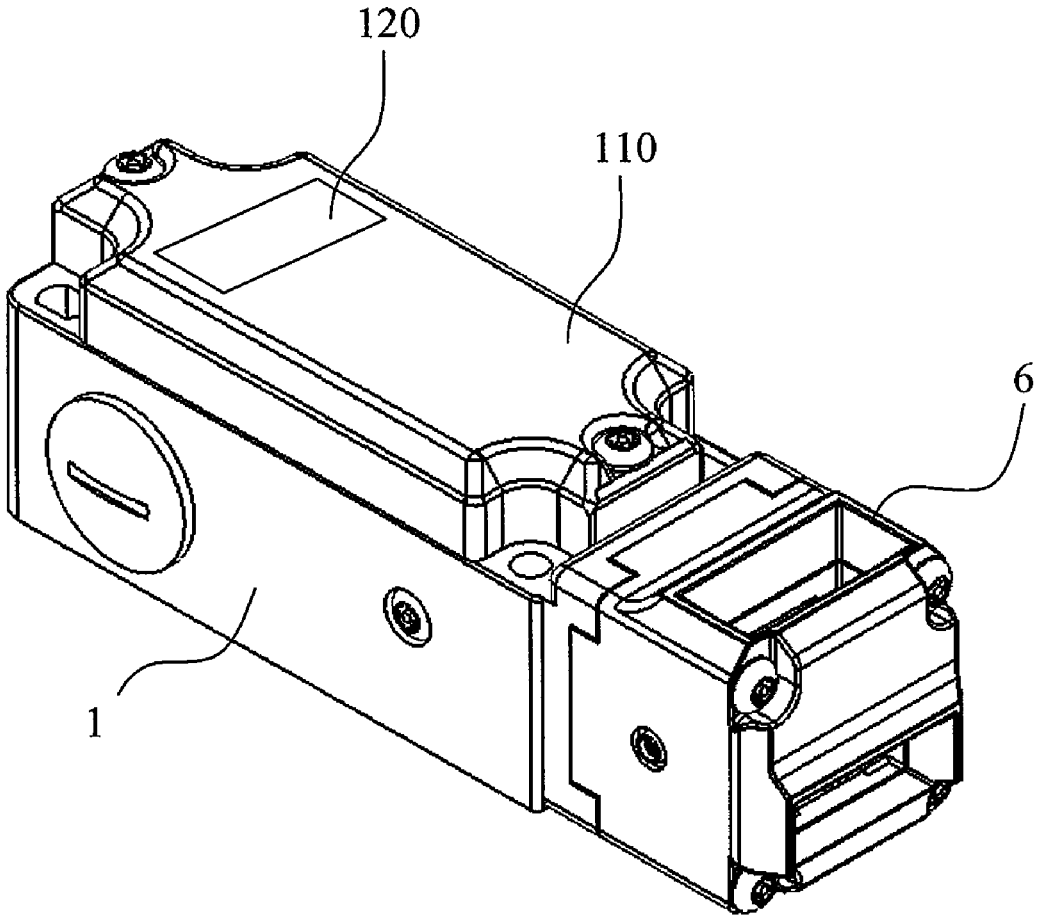
FIG. 5 is a schematic perspective view of a safety switch in accordance with an embodiment of the present invention.

FIG. 5 is a perspective view of the safety switch shown in FIGS. 1 to 3. A difference between the safety switches shown in FIGS. 1 and 3 and that of FIG. 5 is that the safety switch in FIG. 5 is provided with a cover 110. Mounted on or visible through the cover 110 is a display 120. The display 120 may be in electrical connection with the circuitry 100 shown in FIG. 4 so that a user of the safety switch may easily gain access to (e.g. see) information that is indicative of the operation of the safety switch. For example, the display 120 may be the counter mentioned previously, or may be a visual indicator of the counter.

Figure 6A:
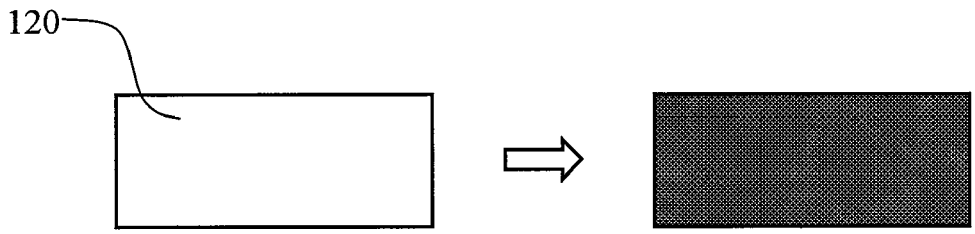
FIGS. 6*a* to 6*d* schematically depict operating principles of a display of the safety switch of FIG. 5 in accordance with an embodiment of the present invention.

FIGS. 6*a* to 6*d* schematically depict examples of how the display 120 can provide information at least indicative of the state of the counter mentioned above. In FIG. 6*a*, it can be seen that the display has changed from a first shade to a second shade. The change in shade may be triggered by the counter approaching a threshold value, equaling a threshold value, or exceeding a threshold value. This threshold value may be equal to the number of times the safety switch was tested for the function or operational feature being counted, for instance the number of times the contacts of the switch have been opened/closed, or the number of times the resistance of the contacts has exceeded a certain level. For instance, the display 120 may change from green to red at which point the user should contact a maintenance engineer, and/or service, fix, and/or replace the switch.

Figure 6B:
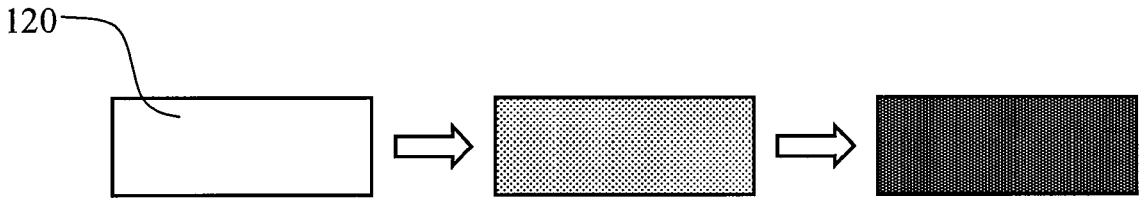

FIG. 6*b* shows that the display 120 may be arranged to display a first colour, then a second colour, and then a third colour. The first colour may be indicative of a counter value which is below a first threshold value. The second colour may be indicative of a counter value which is between the first threshold value and a second threshold value, for instance when maintenance of the switch, or replacement of the switch is recommended. The display 120 could then change to the third colour when the counter value exceeds the second threshold value. This may be, as described above, when the counter exceeds a value for which the switch was tested.

Figure 6C:
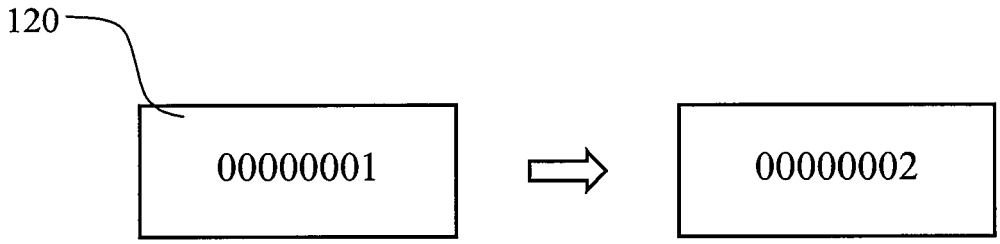

FIG. 6*c* illustrates how the display 120 can display the value of the counter itself, such that the user may accurately determine operational information of the safety switch, for example, the number of times an actuator has been engaged with and disengaged from the safety switch.

Figure 6D:
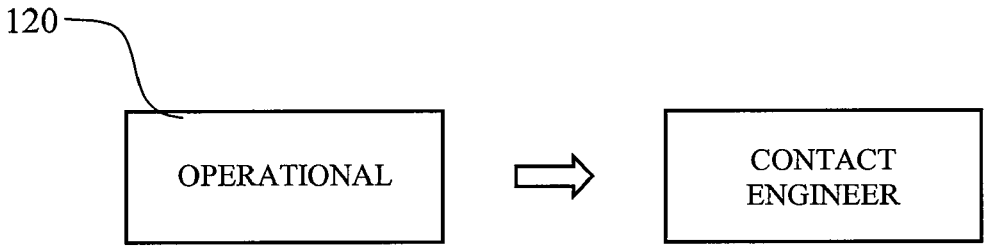

FIG. 6*d* shows how the display 120 can display textual information which may for example provide instructions to the user. For instance, it can be seen in the Figure that the display 120 changes from displaying "OPERATIONAL" to "CONTACT ENGINEER". The display 120 may be arranged to display the term "CONTACT ENGINEER" (or other text) when the counter exceeds a threshold value, for example.

It will be appreciated that the display 120 may be electronic, or mechanical, and may be configured to display any desirable information. The information which the display 120 is configured to display to the user may be dependent upon language requirements, safety requirements or any other requirements. For instance, it may be preferable to use block changes in colour as opposed to text.

Figure 7:
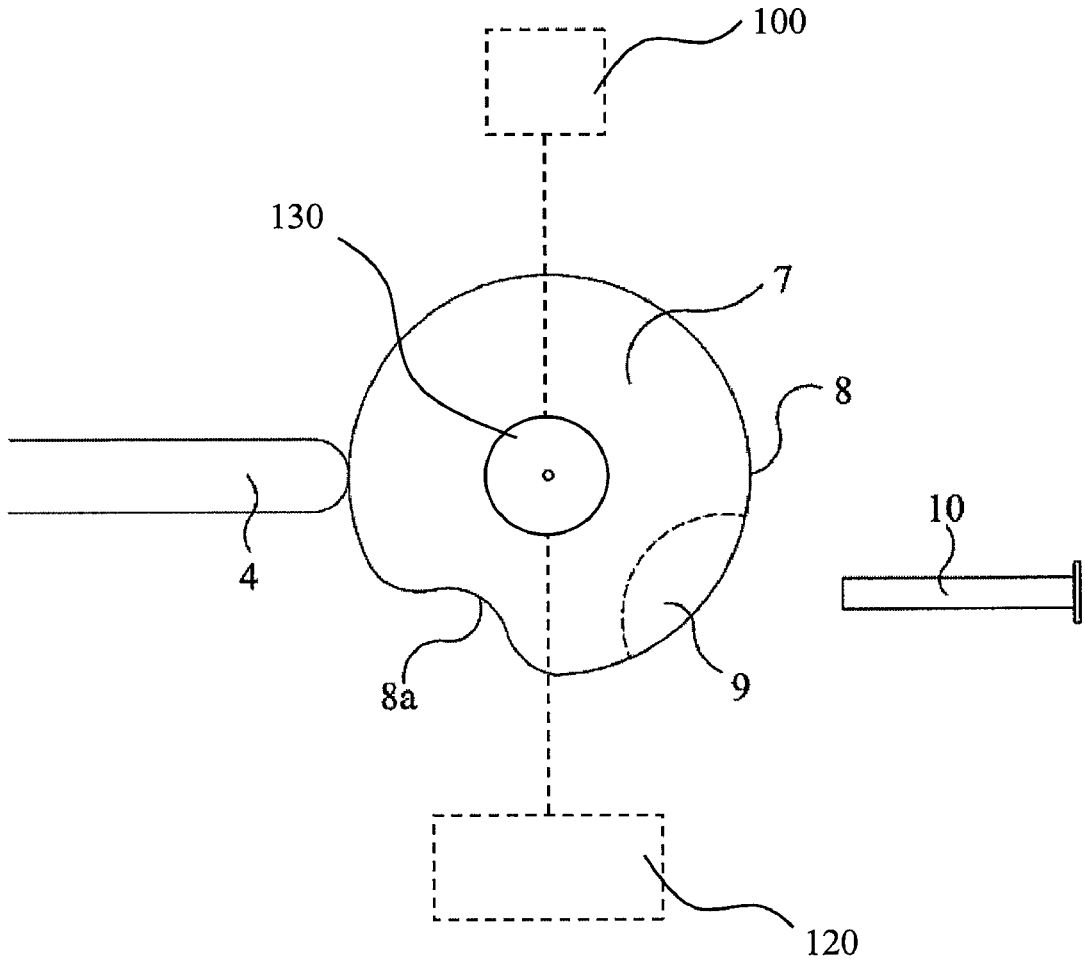
FIG. 7 schematically depicts a mechanical arrangement according to an embodiment of the present invention.

In the foregoing description, circuitry 100 has been described. The circuitry 100 allowed information indicative of the operation of the safety switch to be obtained electrically. It is appreciated that similar and/or other information indicative of the operation of the safety switch may be obtained, at least in part, by mechanical means. FIG. 7 shows the cam arrangement shown in and described with reference to FIG. 2*a*. In FIG. 7, however, a mechanical device 130 is shown in conjunction with the cam arrangement 7. The mechanical device 130 is configured to detect rotation of the cam arrangement 7. Since rotation of the cam arrangement 7 is caused by engagement or disengagement of the cam arrangement 7 with the actuator 10, the mechanical device 130 may be used to detect the number of times the actuator 10 has been engaged with or disengaged from the safety switch. The mechanical device 130 could, for example, be a ratchet mechanism or anything else which may detect or indicate movement of the cam arrangement 7 and/or presence of actuator 10. The mechanical device can be electrically or mechanically coupled to either or both of the circuitry 100 or display 120. For instance, the circuitry 100 could store information at least indicative of the movement of the mechanical device 130. The circuitry 100 could then update a counter to reflect movement of the mechanical device 130. The circuitry 100 could then, in turn, be in communication with the display 120 as described above. Alternatively, the mechanical device 130 could be in electrical or mechanical communication with the display 120. For example, mechanical movement of the mechanical device 130 may be suitable to effect movement of a mechanical display, for instance an incremental counter or the like.

It is further envisioned that, rather than the mechanical detection of movement of the cam arrangement, movement of the contacts or plunger may be mechanically detected. For instance, the contacts or plunger may be arranged to contact a lever or other mechanism each time the contacts or plunger move. In one example, the plunger may be provided with a protrusion which impacts against the lever each time the actuator is engaged or disengaged with the switch. Movement of the lever may be used to increase a mechanical or electrical counter. The number of times that any part of the safety switch moves may be detected and stored to give, for example, an indication of the number of times the switch has been used. The number of times that movement of such a part is detected beyond a threshold value may be stored. For instance, the threshold value may correspond to the amount of movement necessary for the part to move a distance that it would need to move in order for the safety switch as a whole to move from a first condition to a second condition (e.g. to a non-conducting state from a conducting state, or to a conducting state from a non-conducting state).

Alternatively or in addition to displaying information indicative of the operation of the safety switch, other functionality may be provided. For instance, if the electrical or mechanical counter reaches or exceeds a threshold value, the safety switch could be moved to a condition whereby it cannot conduct electricity to electrical machinery that the switch is in connection with. For instance, upon reaching a threshold value the circuitry could be arranged to open or close a switch to ensure that the safety switch cannot conduct electricity to electrical machinery that the switch is in connection with. Upon reaching such a threshold value, opening or closing of a switch could be undertaken mechanically. For instance, in a mechanical incremental counter, when a dial representing the number in the tens of thousands moves from 0 to 1, the movement may trigger the opening or closing of a switch. In another example, the information indicative of the operation of the switch may be stored as well as or instead of initiating incremental switch movement. It is further envisioned that the stored information may be accessed by connecting another device to the safety switch, either using a wired or wireless link. For instance, the circuitry may communicate with a control device in a wired or wireless manner, and the control device could be arranged to control the operating state of machinery based on the information obtained by the circuitry.

In general, the present invention provides a safety switch for affecting the operating state of equipment to which the safety switch is at least indirectly connected. The safety switch includes a configuration that is arranged to change from a first condition to a second condition depending on whether or not an actuator has been engaged with or disengaged from the safety switch. The safety switch includes an arrangement for determining information that is at least indicative of an operational property of the configuration and for storing information that is at least indicative of the obtained information. The safety switch may be directly or indirectly connected to the equipment in a wired or wireless manner, respectively. The configuration could be a set of contacts, as described above, or it could be any electrical, mechanical or electromechanical configuration such as a solid state electronic arrangement or the like. The actuator may physically move at least a part of the configuration, for example the cam arrangement described above. Alternatively, the actuator could be a magnet or other apparatus that can change the state of the configuration without necessarily any physical contact. The arrangement for determining the information could be electrical, mechanical or electromechanical in nature, or a combination of these. The information may be stored in the form of an output, a display or in a memory. The display need not be electrically powered, but could instead be entirely mechanical in nature.

In the embodiments described above, a plurality of safety contacts has been described. However, it will be appreciated that any suitable configuration of safety contacts (and even auxiliary contacts) may be employed. For example, a plunger may be provided with only a single safety contact, and not two as shown in the Figures. In some embodiments a plunger provided with contacts extending through it may be located in a contact block or the like. The plunger in the contact block may be biased against a surface of the cam arrangement. Alternatively, the plunger in the contact block may be biased against an intermediate plunger located substantially outside of the contact block. The intermediate plunger may be biased against the cam arrangement by the contact block plunger.

It will be understood by the skilled person that a contact is a conductor which may be shaped at each of its ends, i.e. to define contact points. In the above described embodiments, the moveable safety and auxiliary contacts are conductors which extend transversely through the plunger, and protrude from both sides of the plunger (e.g. they are bridging contacts). The fixed contacts are conductors fixed in position relative to the housing of the safety switch.

The plunger of the present invention has been described in relation to a safety switch having a fixed set of contacts located and fixed in position in the housing of the safety switch. The fixed contacts of the housing may be individually fixed or integral to the housing, or may form part of a safety switch contact block. The safety switch contact block is a structure that is provided with the fixed contacts (or conductors). The safety switch contact block as whole is fixed in position into the housing. As such, it is appreciated that the fixed safety contacts (conductors) may be formed integrally with the housing, individually fixed in position in the housing, or form part of a contact block which is itself fixed in position in the housing.

In the foregoing description, the safety switch has been described as having a cam arrangement and plunger co-operable with the cam arrangement. It is appreciated that other mechanisms can provide similar operability. Any mechanism may be used to convert the engagement or disengagement of an actuator into, for example, opening and closing of one or more sets of contacts. For example, the engagement of the actuator with the safety switch may push against the contacts themselves. Alternatively, there may be an intermediate structure between the contacts and the actuator. For instance, the actuator may come into contact with and move a rod or elongate element which may push against the contacts or something carrying the contacts.

In the foregoing description, the making or breaking, or opening or closing, of contacts has been described as having the effect of allowing or preventing the safety switch from conducting electricity to electrically powered machinery. Generally, opening or closing of the contacts has the more general effect of changing the operating state of the machinery, for example slowing the machinery down, or stopping its movement while still maintaining its power supply. The changing of the operating state may be controlled directly by the safety switch (e.g. power supplied or not supplied) or by a control arrangement in communication with the safety switch and the machinery. The opening or closing of contacts in the safety switch may be used by the control arrangement to determine the control that is required to alter the operating state of the machinery. For example contacts open/closed may result in the control arrangement controlling the machine such that it slows down.

It will be appreciated by a person skilled in the art that the invention is not limited to the embodiments described above, and that various modifications may be made to those and other embodiments without departing from the invention, which is defined by the claims which follow.

What is claimed is:

1. A safety switch for affecting an operating state of equipment to which the safety switch is at least indirectly connected, the safety switch comprising:

an actuator that removably cooperates with the safety switch to alter an electrically conducting state of the safety switch;

a configuration arranged to change from a first condition to a second condition depending on whether or not the actuator has been engaged with or disengaged from the safety switch; and an arrangement configured to detect at least mechanical movement of a moveable electrical contact of the configuration of the safety switch when the actuator is brought into or out of engagement with the configuration for determining information at least indicative of an operational property of the configuration and indicative of a deviation associated with the electrically conducting state from a preferred condition, and for storing information at least indicative of the determined information.

2. The safety switch of claim 1, wherein the information is at least one of stored with a display device or stored in a memory.

3. The safety switch of claim 1, wherein the configuration is electromechanical.

4. The safety switch of claim 1, wherein the configuration further comprises:

a contact that is fixed in position relative to the safety switch; and a contact that is moveable relative to the safety switch, the moveable contact being moveable into and out of contact with the fixed contact such that electrical current can or cannot flow between the moveable and fixed contacts, respectively.

5. The safety switch of claim 4, wherein the contact that is moveable is carried by a plunger.

6. The safety switch of claim 1, wherein the configuration further comprises:

a fixed pair of contacts that are displaced from one another; and a moveable bridging contact, the moveable bridging contact being moveable into and out of contact with the fixed pair of contacts such that electrical current can or cannot flow through the bridging contact.

7. The safety switch of claim 1, wherein the arrangement is configured to at least one of detect an electrical signal, or detect change in an electrical signal associated with the configuration.

8. The safety switch of claim 7, wherein the arrangement is configured to detect a change in at least one of: a current flowing through the arrangement, a potential difference across the arrangement, or a resistance of the arrangement.

9. The safety switch of claim 8, wherein the arrangement is configured to store information at least indicative of a number of times the change is detected.

10. The safety switch of claim 8, wherein the arrangement is configured to store a value associated with the detected change.

11. The safety switch of claim 10, wherein the arrangement is configured to store the value of at least one of the current, the potential difference, or resistance of the arrangement each time the current, the potential difference, or the resistance of the arrangement is detected to be above or below a predetermined threshold.

12. The safety switch of claim 10, wherein the arrangement is configured to store a number of times the value of the at least one of the current, potential difference or resistance each time the current, potential difference or resistance is detected to be above or below a pre-determined threshold.

13. The safety switch of claim 7, wherein the arrangement comprises an electrical circuit.

14. The safety switch of claim 1, wherein the arrangement is arranged to detect movement of at least one of a cam arrangement, a plunger, a moveable electrical contact of the configuration of the safety switch, or the actuator when it is brought into or out of engagement with the configuration.

15. The safety switch of claim 1, wherein the arrangement is configured to store information associated with a number of times movement is detected.

16. The safety switch of claim 1, wherein the arrangement is configured to store information associated with the number of times movement is detected beyond a threshold value.

17. The safety switch of claim 16, wherein the threshold value corresponds to the amount of movement necessary for the configuration to change from a first condition to a second condition.

18. The safety switch of claim 1 further comprising a counter that may be configured to store information that is indicative of at least an operational property of the configuration.

19. The safety switch of claim 18, wherein the counter is one of electrical in nature, mechanical in nature, or electromechanical in nature.

20. The safety switch of claim 1 further comprising a display arranged to provide a visual indication of information indicative of at least an operational property of the configuration of the safety switch.

21. The safety switch of claim 20, wherein the display is a counter.

22. The safety switch of claim 1, wherein the safety switch is configured to be connected to the equipment at least one of in a wired arrangement and a wireless arrangement.

23. The safety switch of claim 1, wherein the first condition is such that a supply of electricity to the equipment is allowed, and the second condition is such that a supply of electricity to the equipment is prevented.

24. The safety switch of claim 1, wherein the first condition is such that the equipment is arranged to operate at a first speed, and the second condition is such that the equipment is arranged to operate at a second speed.

25. The safety switch of claim 1, wherein the first condition is such that movement of at least a part of the equipment is allowed, and the second condition is such movement of the equipment is prevented.

26. A method of monitoring operation of a safety switch comprising:

detecting a movement directly attributable to an interaction of an actuator with the safety switch which causes changing a conducting state of the safety switch and is independent of a conducting and non-conducting condition of the safety switch;

counting the number of movements detected;

comparing the counted number to a threshhold value; and providing an output indicative of a relationship of the counted number relative to the threshhold value.

* * * * *